United States Patent [19]

Babcock

[11] Patent Number: 5,030,035

[45] Date of Patent: Jul. 9, 1991

[54] EARTH RETAINING SYSTEM

[75] Inventor: John W. Babcock, Huntsville, Utah

[73] Assignee: Earth Structures, Inc., Fort Collins, Colo.

[21] Appl. No.: 564,867

[22] Filed: Aug. 9, 1990

[51] Int. Cl.[5] ..... E02D 29/00

[52] U.S. Cl. ..... 405/262; 405/284; 405/286

[58] Field of Search ..... 405/262, 284, 286, 258

[56] References Cited

U.S. PATENT DOCUMENTS

| | | | |
|---|---|---|---|
| 4,193,718 | 3/1980 | Wahrendorf et al. | 405/262 X |
| 4,524,551 | 6/1985 | Scheiwiller | 405/286 X |
| 4,661,023 | 4/1987 | Hilfiker | 405/262 |
| 4,668,129 | 5/1987 | Babcock | 405/286 X |
| 4,671,706 | 6/1987 | Giardini | 405/286 |
| 4,815,897 | 3/1989 | Risi et al. | 405/284 |
| 4,818,150 | 4/1989 | Jaecklin | 405/262 |
| 4,936,713 | 6/1990 | Miner | 405/286 |

*Primary Examiner*—Dennis L. Taylor
*Assistant Examiner*—J. Russell McBee
*Attorney, Agent, or Firm*—William P. O'Meara

[57] ABSTRACT

A retaining wall system which provides landscape terraces on the face of the structure. The multi-tier retaining wall system uses a plurality of tieback counterfort elements in conjunction with wall panels specifically aligned to produce terraces for landscaping. The design offers a high degree of flexibility in the sizing and spacing of the tieback/counterfort elements so as to meet site specific geometric and geotechnical conditions while using standard precast concrete components or other materials.

7 Claims, 4 Drawing Sheets

EARTH RETAINING SYSTEM

BACKGROUND OF THE INVENTION

1. Field of Invention

The present invention pertains generally to soil engineering and more specifically to retaining walls.

2. Discussion of the Background of the Invention

U.S. Pat. No. 4,668,129 issued May 26, 1987 to Babcock, et. al., discloses a precast concrete retaining wall system which utilizes rigid elements that interact with the surrounding soil to produce an active earth condition of "arching" and redistribution of stresses within the reinforced soil mass. Babcock et. al (129) is specifically incorporated herein by reference for all that it teaches. Although the configurations disclosed by the Babcock (129) are capable of providing high stable walls, the walls have closed concrete faces made of prestressed concrete panels which provide no area for landscaping or plantings.

U.S. Pat. No. 4,050,254 issued Sep. 27, 1977 to Meheen et. al., and U.S. Pat. No. 4,572,711 issued Feb. 25, 1986 to Babcock et. al. disclose similar systems where the precast components are assembled in tiers which are offset horizontally from each other, i.e., setback in ascending tiers, which provides an area suitable for landscaping and planting. Meheen et. al. is specifically incorporated herein by reference for all that it teaches. One disadvantage of the Meheen et. al. configuration is that offsetting the tiers to provide the landscaping area requires considerable area or right-of-way, which in many cases is not available. U.S. Pat. No. 4,655,646 issued to Babcock et. al. discloses another retaining wall system for constructing high walls that employs soil arching in the same manner as the present invention. However, Babcock et. al. (4,655,646) also fails to provide for landscaping or planting on the face of the wall which may be desired for aesthetic purposes. Babcock et. al. (4,655,646) and Babcock et. al. (4,572,711) are also specifically incorporated herein for all that they teach.

Additionally, grade and alignment changes, i.e., elevations and angular changes can be difficult to construct with previous wall systems. For example, special tieback elements may be required in some previous wall systems to provide for grade and alignment changes.

SUMMARY OF THE INVENTION

The present invention overcomes the disadvantages and limitations of the prior art by providing a retaining wall system wherein the facia elements are outwardly tilted in order to provide soil areas for landscaping on the face of the retaining structure. Also, this invention provides improved flexibility for the construction of retaining structures as the new geometry allows grade and alignment changes to be easily accomplished.

The advantages of the present invention are that steeply battered (i.e., nearly vertical) retaining walls may be constructed while maintaining planting terraces within the face of the structure. The present invention also incorporates the geotechnical advantages of "soil arching" as disclosed in Babcock, et. al., ('129) while being comprised of approximately 25% less facia material. Additionally, the tieback elements of the present inventions are simply and easily formed and require less reinforcing steel and concrete than previous systems. This reduction in material reduces the cost of the structure and allows landscaping of the structure to improve aesthetics.

BRIEF DESCRIPTION OF THE DRAWINGS

An illustrative and presently preferred embodiment of the invention is shown in the accompanying drawings wherein.

DETAILED DESCRIPTION OF THE PREFERRED EMBODIMENT OF THE INVENTION

Figure 1:
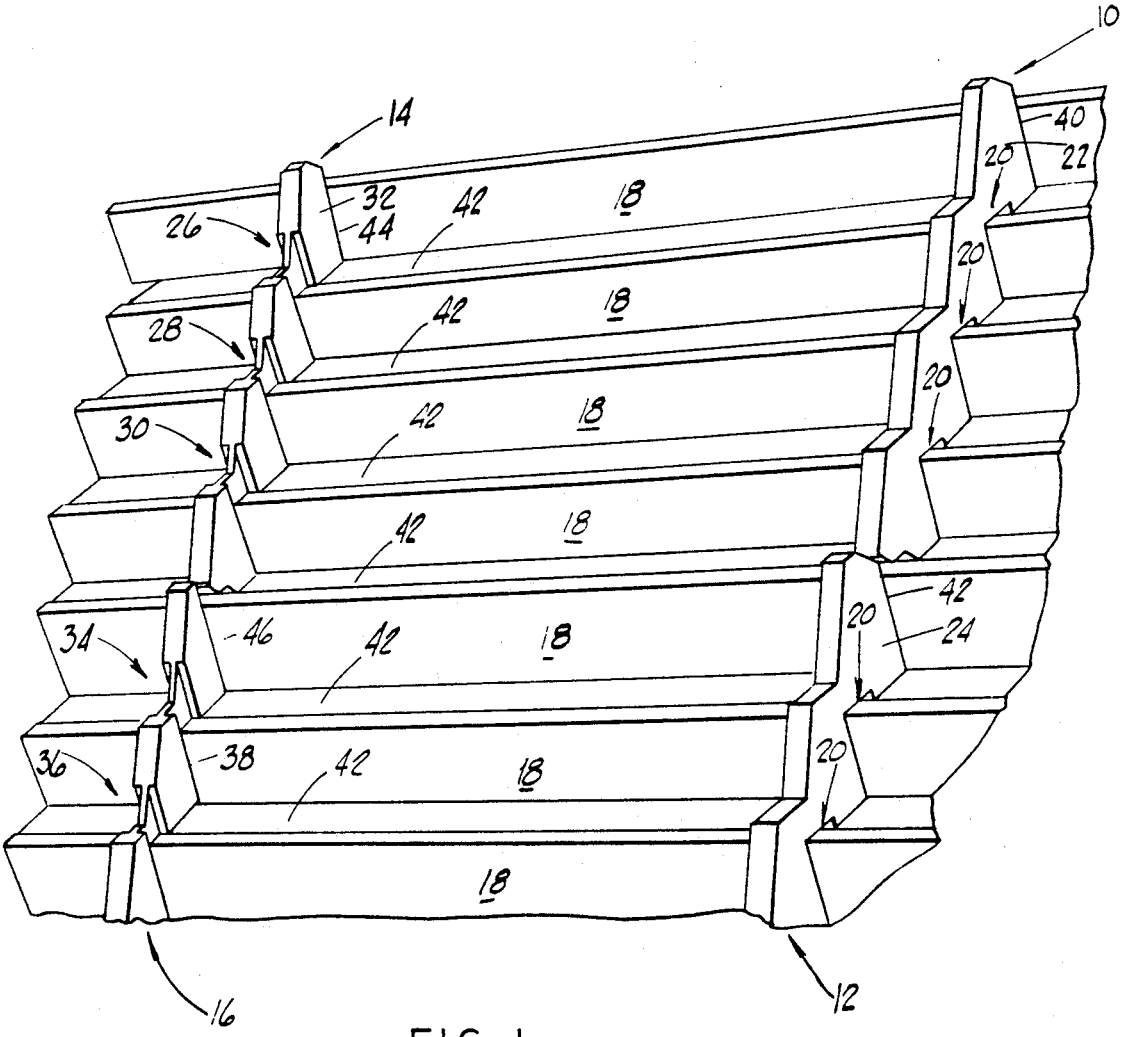
FIG. 1 is a schematic isometric front view of a two tier, seven panel retaining wall illustrating an implementation of various embodiments of the present invention.

FIG. 1 is a schematic isometric drawing of a two tier retaining wall illustrating one manner in which the precast concrete components of the present invention can be configured. The retaining wall system consists of a series of precast concrete tieback counterforts 10, 12, 14 and 16 which support a plurality of precast concrete panels 18 that span between the tiebacks 10, 12, 14 and 16. The tieback elements 10 and 12 engage the precast panels 18 at openings 20 through the tieback web 22 of tieback 10 and through tieback web 24 of tieback 12. Tieback 14 has a series of slots 26, 28 and 30 formed in web portion 32 to accommodate the ends of panels 18. Similarly, tieback 16 has a series of slots 34 and 36 formed in web portion 38 to accommodate the ends of panels 18. Wall panels 18 abut against the top abutment surfaces 40, 42, 44 and 46 of tieback elements 10, 12, 14 and 16, respectively. The weight of the wall panels 18 and the forces of the soil mass 48 hold the wall panels 18 in the position illustrated against abutment surfaces 40, 42, 44 and 46.

Figure 2:
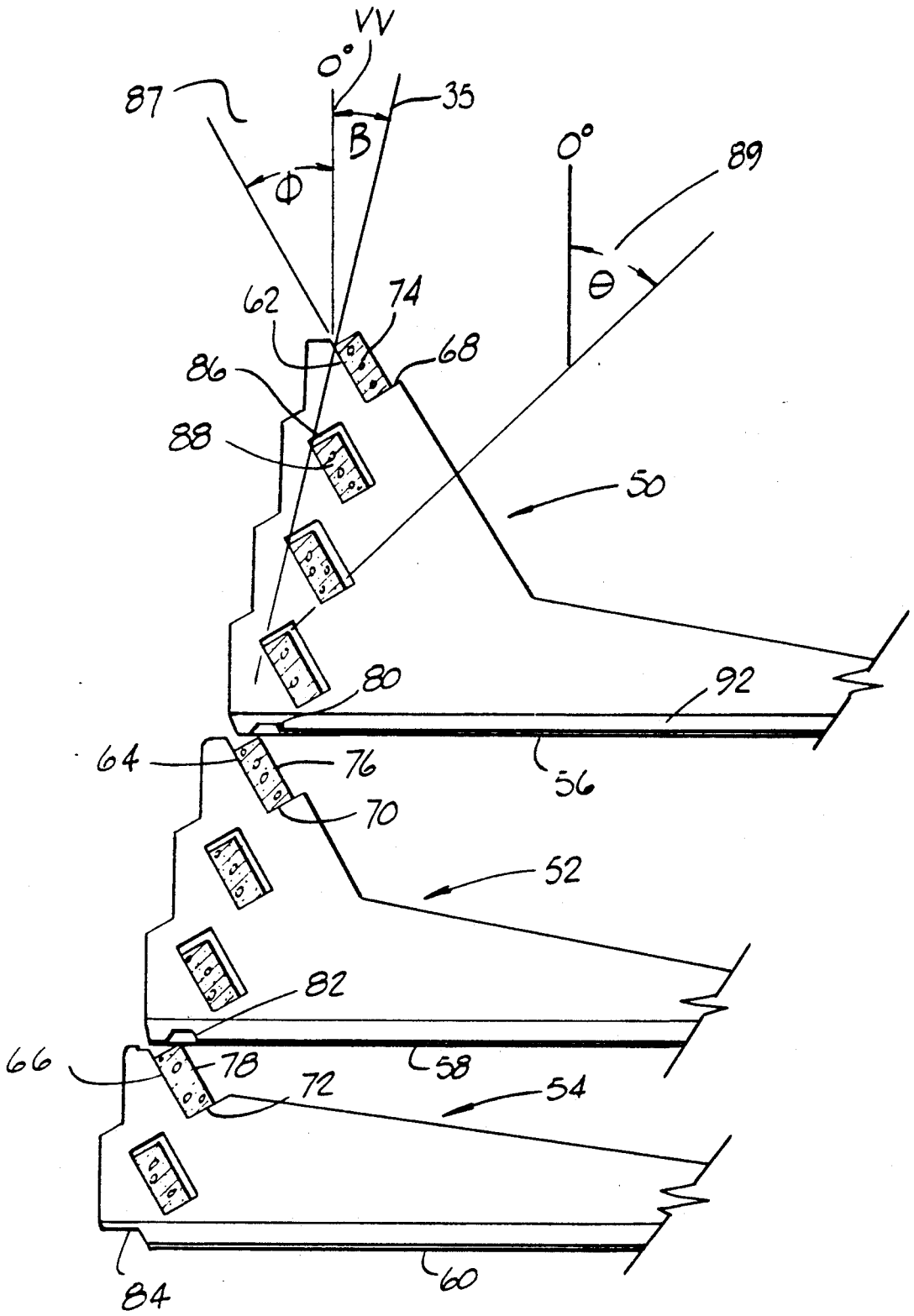
FIG. 2 is a schematic side view of a multi-tiered retaining wall system illustrating the use of two, three and four panel tieback elements.

FIG. 2 is a schematic side view of a multi-tiered retaining wall illustrating stacking of the precast tieback elements 50, 52 and 54. Each of the tieback elements 50, 52 and 54 is placed on a graded compacted backfill surface 56, 58 and 60, respectively, of the next lower tier to construct a retaining structure of the desired height. This method of construction is typical of the wall structures described in the above-referenced patents of John Babcock. Flange portion 92 provides a flat surface for tieback element 50 to be set on the layer 56 of graded backfill. Also illustrated by FIG. 2 are three different heights of tieback counterforts; a four panel tieback 50, a three panel tieback 52, and a two panel tieback 54. These different size tiebacks allow design of varying heights of retaining structures and facilitate grade changes to accommodate changing site elevations. Each of the tieback counterforts 50, 52 and 54 have side abutment portion 62, 64 and 66 and, bottom abutment portion 68, 70 and 72 to hold wall panels 74, 76 and 78, respectively.

As shown in FIGS. 1 and 2, the front face portion of the wall panels are outwardly battered, i.e., tilted away from a vertical plane VV, by a predetermined wall panel angle ($\phi$) and offset both horizontally (inwardly towards the soil mass) and vertically from one another. In this arrangement, a plane defined by the forwardmost point of each wall panel element has a predetermined angle ($\beta$) from the vertical. This configuration creates planting terraces 48 (FIG. 1) between adjacent wall panels which collectively define a generally stairstep-shaped configuration. The planting terraces 48 are sloped between the wall panels at a predetermined terrace angle ($\Theta$) which accounts for the reduction in the amount of material needed for wall panels 18. While individual wall panels 18 are battered outwardly away from the backfill, the overall retaining structure created from the assembled components is battered inwardly towards the backfill which reduces the horizontal earth loads on the structure. This allows high walls to be constructed in an economical manner.

Indented portions 80, 82 and 84 provide space between the tieback units and the wall panel for each lower tier. As disclosed in Babcock, et. al. (129) each of the tieback units must move independently to create the active earth condition of arching to redistribute stresses within the reinforced soil mass. Indented portions 80, 82 and 84 provide sufficient room to allow the tieback units 50, 52, and 54, respectively, to move relative to the tieback element of the wall panel in the next lower tier.

As illustrated in FIG. 2, opening 86 is sufficiently large to allow the wall panel 88 to be inserted and slid through opening 86 at an angle. Opening 86 is carefully designed to allow sufficient room for on-site assembly of the wall panels after the installation of the tieback units. For example, when pre-stressed concrete panels are used as wall panel 88, a crane may be required to lift and slide the wall panel 88 through the opening 86 and this operation needs to be easily accomplished without undue interference with the tieback units. Of course, any type of material could be used for the wall panel units 88, including materials such as wood, plastic, steel and other materials. Similarly, the tieback units could also be constructed using other types of materials including the materials listed above.

Figure 3:
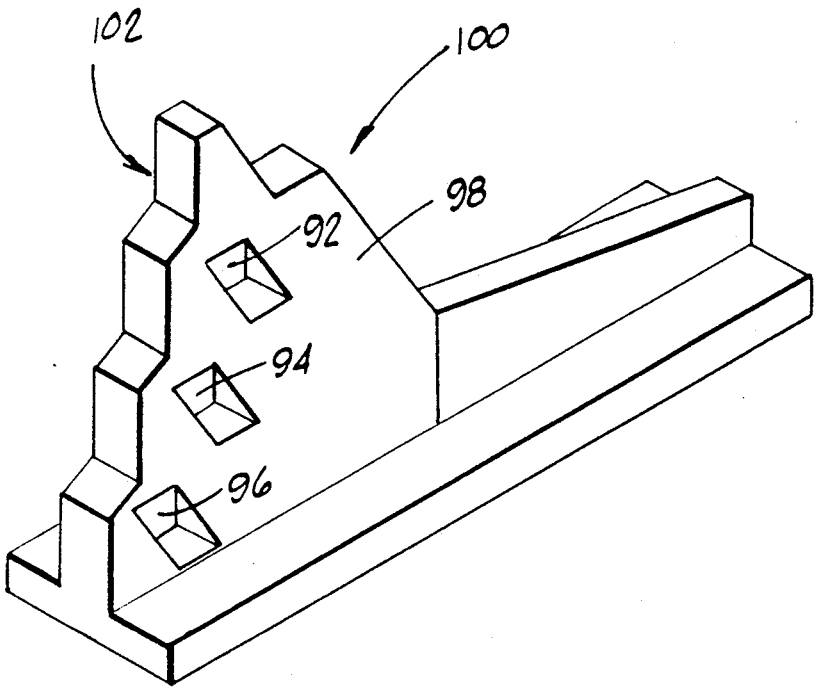
FIG. 3 is an isometric view of one embodiment of a four panel high tieback element illustrating openings in the web portion of the tieback element for coupling of the wall panel elements to the tieback element.

FIG. 3 is an isometric drawing of a four panel tieback counterfort illustrating openings 92, 94 and 96 cast into the tieback web 98 of tieback unit 100 for coupling the wall panels to the tieback counterfort 100. The cast-in-place openings 14 ar dimensionally large enough to facilitate erection of the wall panels 12 and are positioned to provide the desired batter and landscape terraces. Since the front portion 102 of tieback unit 100 does not require a flange as required in previous tieback units, and since the wall panels are coupled to the tieback 100 through openings in web portion 98, a significant amount of material can be eliminated from the tieback unit which reduces the cost of materials and significantly reduces the complexity of the precasting process.

Figure 4:
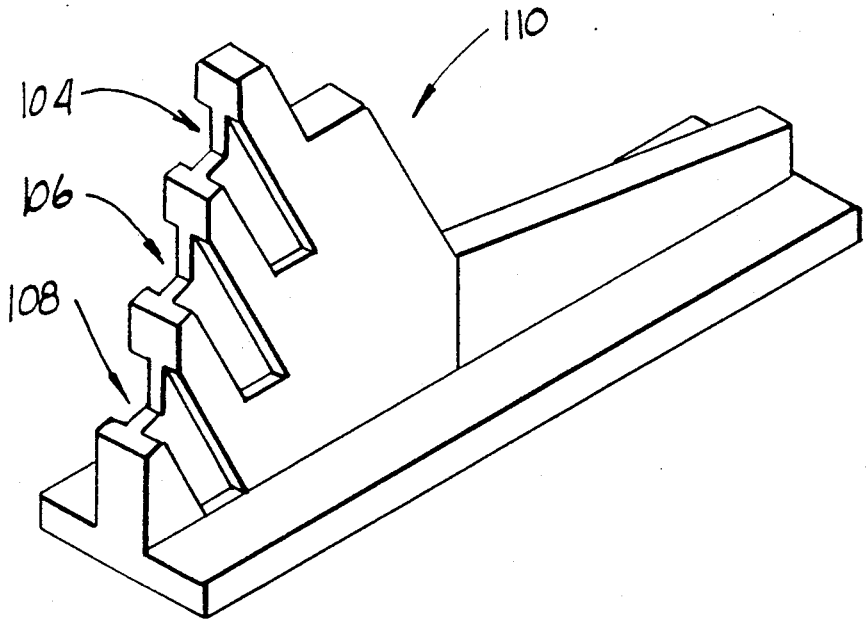
FIG. 4 is an isometric view of another embodiment of a four panel high tieback element illustrating flange elements for the coupling, of wall panel element to the tieback element.

FIG. 4 is an isometric drawing of a four panel tieback counterfort illustrating flanges 104, 106 and 108 cast as an integral part of the tieback for coupling the end portions of precast wall panels to the tieback 110. These flanges provide an alternate method of transferring the loads from wall panels to tieback 110. Either the method depicted in FIG. 3, or the method shown in FIG. 4 may be used successfully with the choice being governed by the wall geometry and structural considerations.

Figure 5:
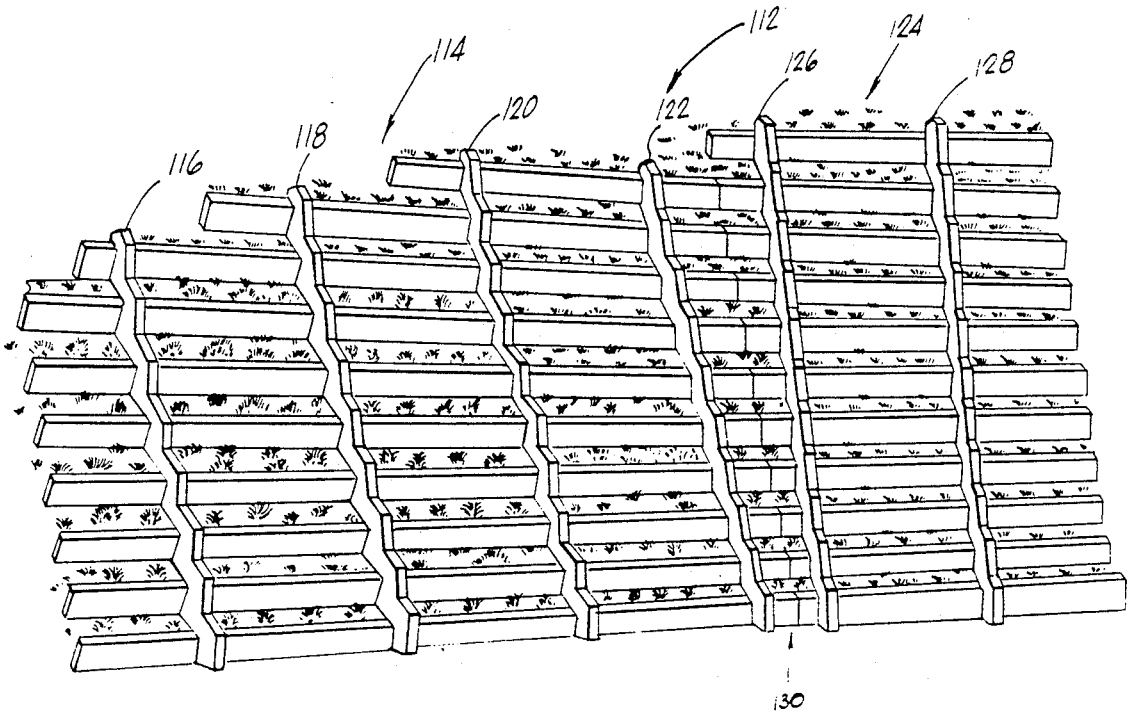
FIG. 5 is a perspective view of an implementation of the wall system of the present invention illustrating the manner in which grade and alignment changes can be accomplished in accordance with the present invention.

FIG. 5 is a perspective view of one implementation of a wall system 112 utilizing the present invention. As illustrated in FIG. 5, a plurality of wall panel units 114 are engaged by tieback units 116, 118, 120 and 122. In a similar manner wall panels 124 are engaged by tieback units 126 and 128. As shown in FIG. 5, wall panels 114 and 124 engage the tieback units through openings such that the wall panel units extend through the tieback units. As stated previously, this allows for changes in grade and alignment. A change in alignment of the wall surface is illustrated at point 130 where the wall panels project from the two wall sections that are aligned at different angles. Additionally, since the radius of the wall face is different at the top of the wall than the bottom, changes in grade can be accomplished by both the battering angle of the wall and the alignment of each of the sections. In this manner, a large degree of flexibility can be provided in constructing a wall of a desired shape.

Consequently, the present invention provides a substantially vertical retaining wall system embodying the advantages disclosed in Babcock, et. al., while using approximately 25% less material and providing landscaping terraces within the face of the structure.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A soil retaining wall for retaining a soil mass in a manner that is capable of providing a steeply battered, nearly vertical wall face while simultaneously allowing for planting areas in said wall face comprising:

wall panel means for engaging and retaining said soil mass such that vertical and horizontal forces produced by solid soil mass act upon said wall panels;

rigid tieback means having a generally horizontally disposed footing portion for engaging said soil mass and producing a moment force in said tieback means to oppose said horizontal and vertical forces acting on said wall panel means by creating an active earth condition of soil arching in said soil mass, and a generally vertically disposed web portion coupled to said footing portion having openings disposed therein for engaging said wall panel means such that said wall panel means are outwardly battered at predetermined wall panel angle ($\phi$) and said openings are both vertically and horizontally displaced in said web means to provide a wall face that is inwardly battered at a predetermined wall face angle ($\beta$) such that a sloped soil terrace is formed between said wall panel means at a predetermined terrace angle ($\Theta$) that creates said planting areas in said wall face and reduces the amount of materials required in said wall panel means.

2. The soil retaining wall of claim 1 wherein said wall panel means have a length that is sufficient to extend through said rigid tieback means such that said horizontal and vertical forces acting on said wall panel means are substantially balanced on each side of said rigid tieback means.

3. The soil retaining wall of claim 1 wherein said wall panel means abut at locations in said soil retaining wall displaced from said rigid tieback means to allow for changes in grade and alignment of said soil retaining wall at locations other than said rigid tieback means.

4. A soil retaining wall for retaining a soil mass in a manner that is capable of providing a steeply battered, nearly vertical wall face while simultaneously allowing for planting areas in said wall face comprising:

wall panel means for engaging and retaining said soil mass such that vertical and horizontal forces produced by said soil mass act upon said wall panels;

rigid tieback means having a generally horizontally disposed footing means for engaging said soil mass and producing a moment force on said tieback means to oppose said horizontal and vertical forces acting on said wall panel means by creating an active earth condition of soil arching is said soil mass, and a generally vertically disposed web portion coupled to said footing portion having slots formed therein for engaging end portions of said wall panel means such that said wall panel means are outwardly battered in a predetermined wall panel angle ($\phi$) and said slots are both vertically and horizontally displaced in said web means to provide a wall face that is inwardly battered at a predetermined wall face angle ($\beta$) such that a sloped soil terrace is formed between said wall panel means at a predetermined terrace angle ($\Theta$) that creates said planting areas in said wall face and reduces the amount of materials required in said wall panel means.

5. A multi-tiered, battered retaining wall system for retaining soil comprising;

wall panel means for retaining said soil by resisting soil forces having vertical and horizontal components generated by said soil acting on said wall panel means having standardized predetermined height, width, and relative alignment along the face of said retaining wall system;

rigid tieback means disposed in said soil behind said wall panel means at intervals which vary in accordance with geotechnical conditions and said soil producing a moment force on said tieback means to oppose said horizontal and vertical forces acting on said wall panel means;

coupling means on said rigid tieback means diagonally disposed to said soil for transferring said horizontal and vertical soil forces on said wall panels to said tieback means;

terrace means between said wall panel means for landscaping the face of said retaining wall system.

6. The retaining wall system of claim 1 wherein said tieback means comprises:

base means which extends horizontally into the retained soil to support said tieback means and generate pre-determined opposing movement forces;

web means having a volume are sufficiently large to resist and transfer forces from wall panel means to said base means;

hole means diagonally disposed in said web means for engaging said wall panel means and positioned at pre-determined positions in said web means to cause said wall panel means to produce terrace means between said wall panel means suitable for landscaping.

7. The retaining wall system of claim 1 wherein said tieback means further comprises:

base means which extends horizontally into the retained soil to support said tieback means and generate pre-determined opposing movement forces;

web means having a volume are sufficiently large to resist and transfer forces from wall panel means to said base means;

flange means diagonally disposed on said web means for engaging said wall panel means and positioned at pre-determined positions on said web means to cause said wall panel means to produce terrace means between said wall panel means suitable for landscaping.

* * * * *